US009267654B1

(12) United States Patent
Lloret

(10) Patent No.: US 9,267,654 B1
(45) Date of Patent: Feb. 23, 2016

(54) ELECTRONIC CANDLE ASSEMBLY AND METHODS OF USE

(71) Applicant: Antonio R. Lloret, Staten Island, NY (US)

(72) Inventor: Antonio R. Lloret, Staten Island, NY (US)

( * ) Notice: Subject to any disclaimer, the term of this patent is extended or adjusted under 35 U.S.C. 154(b) by 15 days.

(21) Appl. No.: 14/306,747

(22) Filed: Jun. 17, 2014

Related U.S. Application Data

(60) Provisional application No. 61/835,956, filed on Jun. 17, 2013.

(51) Int. Cl.

| | |
|---|---|
| ***F21L 19/00*** | (2006.01) |
| ***F21S 10/04*** | (2006.01) |
| ***H05B 33/08*** | (2006.01) |
| ***H05B 37/02*** | (2006.01) |

(52) U.S. Cl.
CPC ..... *F21S 10/04* (2013.01); *H05B 33/08* (2013.01); *H05B 37/02* (2013.01)

(58) Field of Classification Search
USPC ..... 362/161, 392, 393, 565, 569; 315/185 R, 209 R, 246, 313, 320, 321
See application file for complete search history.

(56) References Cited

U.S. PATENT DOCUMENTS

| | | | | |
|---|---|---|---|---|
| 4,187,532 | A | 2/1980 | Naffier | |
| 5,936,521 | A | 8/1999 | Blackman | |
| 8,496,345 | B2 * | 7/2013 | Chan | H05B 37/0236 362/161 |
| 8,770,782 | B2 * | 7/2014 | Ye | H05B 37/0227 315/86 |
| 2006/0291198 | A1 * | 12/2006 | Dalton | F21L 4/005 362/191 |
| 2008/0117634 | A1 | 5/2008 | Wong | |
| 2008/0158863 | A1 | 7/2008 | Tsai | |

FOREIGN PATENT DOCUMENTS

WO WO2005/095846 10/2005

OTHER PUBLICATIONS

Texas Instruments Inc., LM555 Integrated Circuit Brochure, downloaded on Jun. 5, 2014 from World Wide Web address "http://www.ti.com/lit/ds/symlink/lm555.pdf", 21 pages, Dallas, TX, USA.

* cited by examiner

*Primary Examiner* — Minh D A
(74) *Attorney, Agent, or Firm* — John J Brooks, III; John Brooks Law LLC

(57) ABSTRACT

An electric candle assembly is disclosed comprising a body, a light, a power source conductively attached to a control element, control circuitry to control the conductivity between the power source and the light, the control circuitry comprises a threshold circuit to switch the light from an on mode to an off mode and the threshold circuit is configured to receive a force on the light from a gas whereby the force moves the light and moves the second threshold switch contact from an unflexed position to a flexed position and switches the light from the on mode to the off mode. In some embodiments the control element is an integrated circuit such as a 555 integrated circuit. Embodiments of methods to use the candle assembly are also disclosed.

20 Claims, 8 Drawing Sheets

ELECTRONIC CANDLE ASSEMBLY AND METHODS OF USE

CROSS-REFERENCE TO RELATED APPLICATIONS

This application claims the benefit of U.S. App. No. 61/835,956, filed on Jun. 17, 2013, entitled "L.E.D. Birthday/Occasion Candle," the entire contents of which are incorporated herein by reference.

STATEMENT REGARDING PRIOR DISCLOSURES BY THE INVENTOR OR A JOINT INVENTOR

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

1. Field of the Invention

This application relates to electronically powered devices, in particular electronically powered lights that are capable of being switched on an off by a small force such as blowing on an area of the device.

2. Description of the Prior Art

Electrically powered lights, in particular battery powered candles are now available in the market.

U.S. Pat. No. 4,187,532 issued on Feb. 5, 1980 to Vernon H. Naffier which is herein incorporated by reference in its entirety teaches an electronic candle capable of being actuated by an air-pressure switch. The shape of elements of Naffier, particularly the flame element does not closely resemble the flame of a normal candle and the candle is switched off by air received at an aperture of the assembly.

U.S. Pat. No. 5,936,521 issued on Aug. 10, 1999 to John A. Blackman which is herein incorporated by reference in its entirety teaches a piezo film sensor switch capable of being actuated by blowing air through two holes in the candle body.

U.S. Pat. No. 8,496,345 issued on Jul. 30, 2013 to Fu Hsing Chan which is herein incorporated by reference in its entirety teaches a sound controlled candle. However, due to the circuitry used, the shape of the candles of Chan does not resemble the thin stem of a candle such as a birthday candle. Chan discloses switching off the candle by blowing on a reed and sound pipe positioned around the assembly.

US Pub. No. 2008/0117634 published on May 22, 2008 to Sau Man Wong which is herein incorporated by reference in its entirety teaches a candle actuated by generating sounds or by blowing on the candle. However, Wong requires a user to blow at a certain part of the candle, not generally around or on the light.

US Pub. No. 2008/0158863 published on Jul. 3, 2008 to Sam Tsai which is herein incorporated by reference in its entirety teaches a candle actuated by micro-control means that may react to a force such as blowing on the candle. Tsai requires a user to blow at a certain part of the candle, not generally around or on the light.

PCT Pub. No. 2005/0095846 for PCT App. No. PCT/GB2005/001287 published on Oct. 13, 2005 to Oliver, Henry Theobald which is herein incorporated by reference in its entirety teaches a light actuated by a force such as blowing on the candle. Oliver also requires a user to blow at a certain part of the candle, not generally around or on the light.

In addition to the shortcomings above, these embodiments generally have a limited direction that can be used to switch off the light and they generally do not actuate the switching of the light into the off mode by a reactionary movement of the light as a reaction to a blowing force.

BRIEF SUMMARY OF THE INVENTION

The following summary is included only to introduce some concepts discussed in the Detailed Description below. This summary is not comprehensive and is not intended to delineate the scope of protectable subject matter, which is set forth by the claims presented at the end.

In one example embodiment, an electronic candle assembly is provided that provides a simulated candle having a similar size and shape of an elongated candle. These designs can be more aesthetically pleasing than many of the electronic candle designs available today. Embodiments of the electronic candle are also able function similar to a normal candle wherein the simulated flame may be turned off by a person blowing on the simulated flame from many different directions. Embodiments of the simulated candle provide an ability to have simulated candles in environments where real candles would be dangerous or would not be allowed. Examples of such environments include hospitals, health care facilities, transportation facilities, educational facilities, nursing homes, homes for the aging and areas having large amounts of oxygen or other highly flammable materials. Such simulated candles can also provide a much safer environment for common situations where candles are used such as at children's birthday parties, holidays and other common events where candles are typically used.

In one example embodiment, an electronic candle assembly is provided comprising a light, a power source conductively attached to a control element and control circuitry to control the conductivity between the power source and the light. The control circuitry comprises a threshold circuit to switch the light from an on mode to an off mode and the threshold circuit is configured to receive a force on the light from a gas whereby the force moves the light and moves the second threshold switch contact from an open threshold circuit position to a closed threshold circuit position and switches the light from the on mode to the off mode.

In another example embodiment, an electronic candle assembly is provided comprising a body having a distal end, a control circuit comprising a threshold circuit, the threshold circuit comprising a control element conductively attached to a light and a first and second threshold switch contact, the control circuit configured to switch the conductivity to a light between an on mode and an off mode, the second threshold switch contact configured to move between an unflexed position and a flexed position, the unflexed position defines the gap between the first threshold switch contact and the second switch threshold contact and the flexed position defines a conductive contact of the first threshold switch contact and the second threshold switch contact whereby the conductive contact switches the light from the on mode to the off mode. In some embodiment, the light defines an area to receive a force from a gas and the force moves the light and moves the second threshold switch contact from the unflexed position to the flexed position whereby the force from the gas switches the light from the on mode to the off mode. In some embodiments, the second threshold switch contact is positioned on a distal end of a staff and the second threshold switch contact is configured to move between the unflexed and the flexed position by a flex of the staff or a flex of a hinge coupled to the staff. In some embodiments, the first threshold switch contact comprises a conductive ring and the second threshold switch contact comprises a conductive element capable of conductively contacting the conductive ring. In some embodiments, the conductive element is capable of conductively contacting the conductive ring through a 360 degree direction of flex. In some embodiments, the control circuit further comprises a power circuit comprising a power switch configured to conductively attach a power source to the control element. In some embodiments, the conductive contact of the first threshold switch contact and the second threshold switch contact is a momentary conductive contact that switches the light from the on mode to the off mode and the light remains in the off mode after a subsequent conductive contact.

In one example embodiment, a switchable electric device is provided comprising control circuitry configured to switch a device from an on mode to an off mode, a second threshold switch contact and a body having a second threshold switch contact. The second threshold switch contact is configured to move between an unflexed position and a flexed position in response to a force on the device from a gas, the unflexed position defines a gap between the first threshold switch contact and the second switch threshold contact and the flexed position defines a conductive contact of the first threshold switch contact and the second threshold switch contact whereby the conductive contact actuates the control circuitry and switches the device from the on mode to the off mode. In some embodiments, the first threshold switch contact is positioned on the distal end of the body, the second threshold switch contact is positioned on the distal end of the staff and the unflexed position comprises a flexing of the staff whereby the second threshold switch contact moves been the unflexed position and the flexed position. In some embodiments, the staff comprises a swivel ball, the second threshold switch contact comprises a proximal end of a lead conductively attached to the device, the first threshold switch contact comprises a contact in conductive contact with a power source and the unflexed position comprises a rotation of the swivel ball whereby the swivel ball moves been the unflexed position and the flexed position. In some embodiments, the device comprises a light, the control circuitry comprising a control element, a threshold circuit, a device circuit and a power circuit, the power circuit comprising an on/off switch conductively attached with the control element, the device circuit comprising the light conductively attached with the control element, the power circuit comprising a power source conductively attached with the control element, the staff having a proximal end and a distal end, the light positioned on the distal end of the staff, the second threshold switch contact is positioned on the distal end of the staff and the first threshold switch contact is positioned on a distal end of the body whereby a force on the light moves the staff from the unflexed position to the flexed position and the conductive contact of the second threshold switch contact with the first threshold switch contact switches the device from the on mode to the off mode.

In some embodiments, the control element comprises a 555 integrated circuit.

In one example embodiment, a method of using an electronic candle assembly, the method is disclosed, the method comprising providing a portable electronic candle assembly, switching a power switch to conductively attach a power source to the control element and the light and blowing on the light to cause the threshold circuit to switch the light from the on mode to the off mode.

BRIEF DESCRIPTION OF THE SEVERAL VIEWS OF THE DRAWINGS

In order that the manner in which the above-recited and other advantages and features of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE INVENTION

Switchable electric devices and methods of use will now be described in detail with reference to the accompanying drawings. It will be appreciated that, while the following description focuses on a switchable systems such as electronic candle assemblies that provide a light switched by a blowing force, the systems and methods disclosed herein have wide applicability. For example, the electronic candle assembly is one embodiment of a switchable electric device as disclosed and such switchable devices may be readily employed with wind sensitive switches, tilt switches or other electronic assemblies that benefit from a sensitive switching mechanism. Notwithstanding the specific example embodiments set forth below, all such variations and modifications that would be envisioned by one of ordinary skill in the art are intended to fall within the scope of this disclosure.

One Embodiment of the Electronic Candle Assembly:

The electric candle assembly generally comprises a body, a light and a control circuit conductively attached to the light. The control circuit generally allows the assembly to switch conductivity to the light between an on mode and an off mode. In some embodiments, the control circuit allows the electric candle assembly to be switched by a blowing of air on the light which creates a conductive contact between two threshold switch contacts.

Figure 1A:
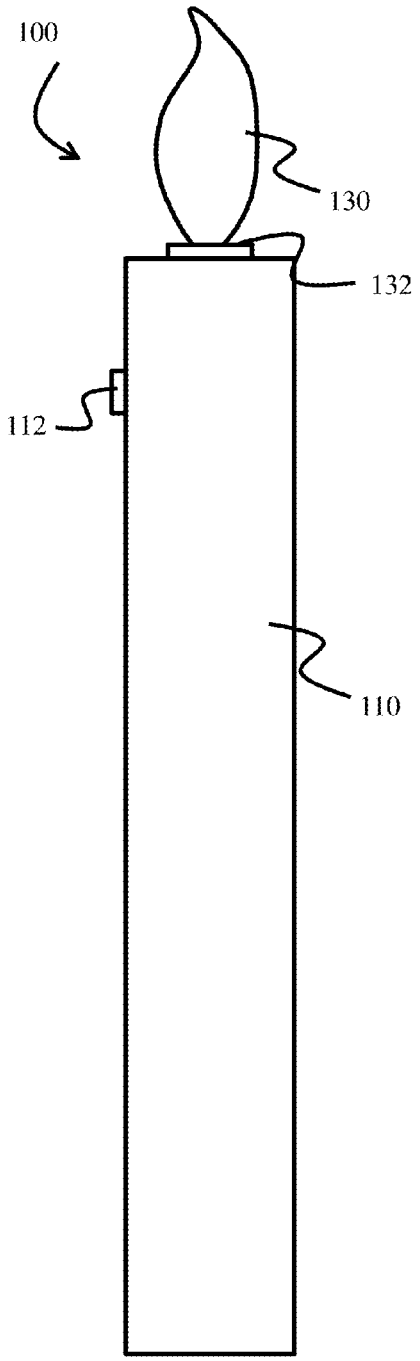
FIG. 1A shows an assembled view of one embodiment of an electronic candle assembly.
Figure 1B:
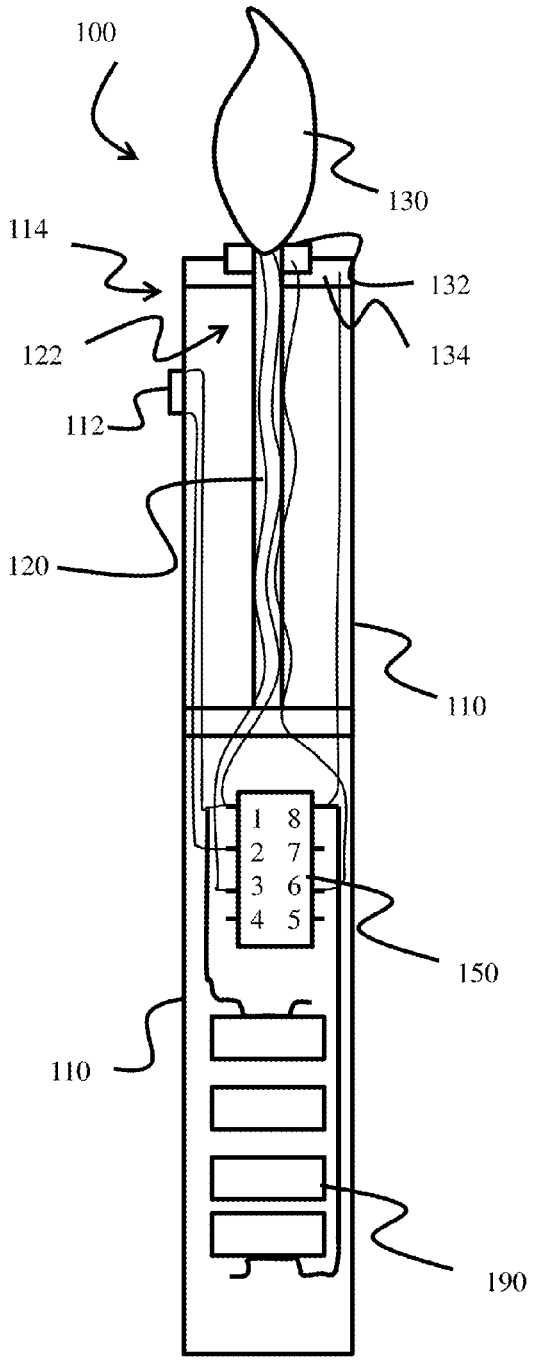
FIG. 1B shows a cut-away view of one embodiment of an electronic candle assembly.

For illustration purposes and not for limitation, one embodiment of the present invention is shown in FIGS. 1A and 1B. FIG. 1A shows an exterior view of one embodiment of the electric candle assembly 100 as assembled. Although not required, in the example embodiment shown, the candle design allows the electric candle to be shaped similar to a common elongated candle stick and allows the device to be switched into an off mode by receiving a force from any of 360 degrees of direction around the candle.

FIG. 1B shows an interior view of the embodiment of FIG. 1A where the electric candle assembly 100 comprises a device 130, such as a light bulb or an LED light, and a power source 190 conductively attached to a control element 150. The device 130 may be any type of electronic device powered by a power source. For example and not for limitation, when used as an electronic candle, the device 130 may be an incandescent light, a florescent light, a luminescent light such as a solid-state/LED light or any other electronic device capable of emitting light. The power source 190 may be any power source appropriately sized to power the device 130, the control element 150 and other assembly circuitry. For example and not for limitation, the power source 190 may be one or more batteries capable of providing 6 volts to the assembly. In a preferred embodiment, the light is an LED light and the power source is one or more batteries providing between 4.5 and 6 volts to the assembly.

As shown in FIG. 1B, the electric candle assembly further comprises structural elements defining the assembly such as a body 110 having a distal end 114, a staff 120 having a distal end 122 coupled to the device 130.

The conductive attachment of elements of the electric candle assembly through the different configurations and states of operation defines a control circuit capable of controlling the conductivity of the power source and current to the device. The control circuit comprises any means to control power to the device 130. For example, and not for limitation, the control circuit comprises a circuit that is able have a provide an output, or voltage, level of high to the device 130 when power is provided by a switch and the control circuit is also able to switch the output level to the device 130 to low when another event occurs such as, but not limited to switching a part of the circuit or exceeding a voltage at a part of the circuit. The control circuit may comprise a combination of circuits, switches and/or control elements conductively coupled together with leads and/or wires that together react to an external force stimulus. In some embodiments, the control circuit includes control elements to control and switch connectivity. Control elements may comprise any device or circuitry that is capable of controlling and switching connectivity to the device in response to an external stimulus. In some embodiments, the external stimulus is communicated to the control element through the control circuitry. For illustration purposes and not for limitation, control elements may comprise devices such as toggle switches, contact switches, circuit breakers, tilt switches, transistors or integrated circuits such as 555 integrated circuits. Although not shown in FIG. 1B, the control circuit may also include additional electronic components such as resistors, capacitors, transistors and other components as dictated by the circuit design.

In the example embodiment of FIG. 1B, the control circuit further comprises a threshold circuit, a device circuit and a power circuit. The threshold circuit comprises any circuit to recognize and alter a circuit based on the value of a voltage at a certain part of the circuit as compared to a threshold value. The value of voltage to alter the circuit may be a value exceeding the threshold value or the value may be a value under the threshold value. In some embodiments, the value to alter the circuit may be the absence of a voltage. In example embodiments, the threshold circuit comprises any switchable conductive attachment between the control element 150 and the device 130. The device circuit comprises any conductive attachment between the device 130 and the control element 150. The power circuit comprises any conductive attachment between the power source 190 and the control element 150 that is conductively attached with the device 130. It is understood that conductive attachment with the control element 150 includes conductive attachment with the internal circuitry of the control element 150.

As shown in FIG. 1B, the device circuit comprises a conductive attachment of the control element 150 to the device 130 whereby the control element can switch the device 130 between an on mode and an off mode. In this embodiment, this conductivity is provided by a first lead conductively attached to a first contact of the light with a positive end of the control circuit and a second lead conductively attached to a second contact of the light and a negative end of the control circuit. The leads extend from the control element 150 to the device 130 and are configured to provide power to the device 130.

As shown in FIG. 1B, the power circuit comprises a power source 190 conductively attached with the control element 150 whereby the control element 150 can switch the device, here light 130, between an on mode and an off mode. In this embodiment, this conductivity is provided by leads conductively attaching the power source 190 with the control element 150. In this embodiment, conductivity is also controlled by an on/off switch 112 to close and switch the device circuit between an on mode and an off mode.

As shown in FIG. 1B, one example embodiment of a threshold circuit comprises a first lead, a first threshold switch contact 134 proximal to the distal end of the body, a second lead and a second threshold switch contact 132 proximal to the distal end 122 of the staff 120. The first lead conductively attaches the threshold circuit and the first threshold switch contact 134. The second lead conductively attaches the threshold circuit and the second threshold switch contact 132. In this embodiment, the threshold circuit is configured to actuate a function of the control circuit such that it switches the conductivity to the light 130 between an on mode and an off mode. The second threshold switch contact 132 is configured to move between an unflexed and a flexed position where the unflexed position defines a gap between the first threshold switch contact 134 and the second threshold switch contact 132 and the flexed position defines a conductive contact of the first threshold switch contact 134 and the second threshold switch contact 132. This conductive contact is a contact that allows a current or electric power to flow between the two threshold switch contacts. In some embodiments, when a power source 190 is connected to the control circuit, the light 130 may be in an on mode and the conductive contact of the first and second threshold switch contacts switch the light 130 from the on mode to the off mode. In some embodiments, when the power source 190 is connected to the control circuit, the light 130 may be in an off mode until an on/off switch switches the light 130 from the off mode to the on mode.

As shown in FIG. 1B, one embodiment of a threshold circuit comprises the staff 120 having a proximal end and a distal end 122, the light 130 positioned on the distal end of the staff 120, the second threshold switch contact 132 positioned on the distal end 122 of the staff 120 and the first threshold switch contact 134 positioned on a distal end of the body 110 whereby a force on the light 130 moves the staff 120 from the unflexed position to the flexed position and the second threshold switch contact 132 conductively contacts the first threshold switch contact 134 and switches the light 130 from the on mode to the off mode.

In the threshold circuit, the staff 120 may be made from any material that allows the second threshold switch contact move in response to the desired force on the device 130. The staff 120 may be configured to move between the unflexed and the flexed position by one of a flex of the staff 120, a flex of a hinge coupled to the staff 120 or a rotation of the staff 120. If the staff 120 is configured to have its distal end flex while it's proximal end stays stationary, the staff 120 should be shaped and made from a flexible material such that it will allow for the appropriate flex along its longitudinal axis. For example, the staff 120 may be a thin plastic or a thin metal such as a wire that is capable of flexing along its length. If the staff 120 is configured to flex through a hinge at its proximal end, the staff 120 may be shaped and/or made from a more rigid material while the hinge is configured to allow the staff 120 to flex. The conductive contact of the first threshold switch contact 134 and the second threshold switch contact 132 may be a momentary conductive contact and the momentary conductive contact may switch the light 130 from the on mode to the off mode allowing the light 130 to remain in the off mode after a subsequent conductive contact.

Figure 2A:
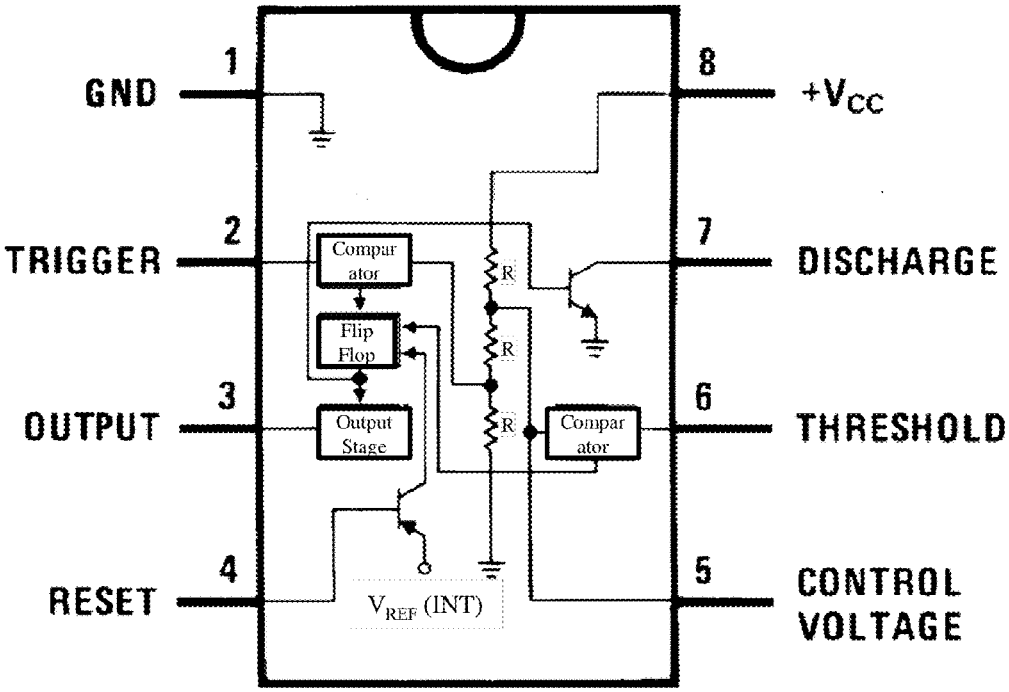
FIG. 2A illustrates the internal circuitry and pinouts of a 555 integrated circuit.

In some embodiments, the control element comprises a 555 Integrated Circuit as sold by Texas Instruments of Dallas Tex. under the model number of SN72555 and SN52555. In some embodiments, the 555 IC is a Complementary Metal-Oxide-Semiconductor (CMOS) IC which can be very efficient in extending the life of a battery power source even if connected to the control element. Referring to FIG. 2A, the pins/pinouts of one embodiment of the 555 IC and their purpose are listed in the table below:

| Pin/ Pinout | Name | Purpose |
|---|---|---|
| 1 | GND | Ground reference voltage, low level (0 V). |
| 2 | TRIG | The OUT pin goes high and a timing interval starts when this input falls below ½ of CTRL voltage (which is typically ⅓ of $V_{CC}$, when CTRL is open). |
| 3 | OUT | This output is driven to approximately 1.7 V below + $V_{CC}$ or GND. |
| 4 | RESET | A timing interval may be reset by driving this input to GND, but the timing does not begin again until RESET rises above approximately 0.7 volts. Overrides TRIG which overrides THR. |
| 5 | CTRL | Provides "control" access to the internal voltage divider (by default, ⅔ $V_{CC}$). |
| 6 | THR | The timing (OUT high) interval ends when the voltage at THR is greater than that at CTRL (⅔ $V_{CC}$ if CTRL is open). |
| 7 | DIS | Open collector output which may discharge a capacitor between intervals. In phase with output. |
| 8 | $V_{CC}$ | Positive supply voltage, which is usually between 3 and 15 V depending on the variation. |

Figure 2B:
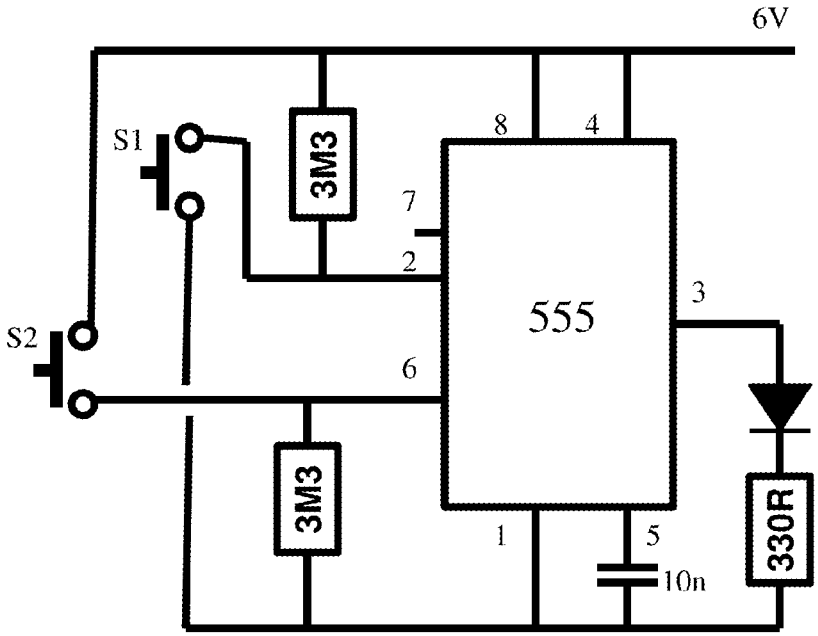
FIG. 2B illustrates one embodiment of the control circuit utilizing a 555 integrated circuit.

FIG. 2B illustrates the resulting control circuit resulting from one embodiment of the electric candle assembly similar to that of FIG. 1B using a 555 IC as the control element. As shown, the circuitry is similar to a touch on and off switch where the output is initially in a low state and switch S1 is able to turn the control element output to high so that the device is powered and the other switch S2 turns the output to low so that the device is turned off. In this embodiment, the first switch S1 is represented by the on/off switch of FIG. 1B such that when it is pushed momentarily, the device will be turned on and the second switch S2 is represented by the threshold switch contacts such that then a conductive contact is made, the device is turned off. As configured, after the second switch S2 is switched, the device will stay off until the first switch S1 is switched to reset the circuitry of the control element 150.

In this embodiment, the control element is attached to the rest of the control circuit as follows:

a pinout #1 to a negative contact of an on/off switch 112 and a negative contact of the light 130;

a pinout #2 to a positive contact of the on/off switch 112;

a pinout #3 to a positive contact of the light 130;

a pinout #6 to the negative second threshold switch contact 132; and a pinout #8 to the positive first threshold switch contact 134.

In this embodiment, the threshold circuit is defined by the lead from pinout #6 to the second threshold switch contact 132 on the distal end of the staff 120, the lead from pinout #8 to the first threshold switch contact 134 on the distal end of the body 110 and the control element circuitry associated with these pins. The power circuit is defined by the power source 190 such as a battery, a negative contact from the power source to pinout #1, a positive contact from the power source to pinout #8 and the control element circuitry associated with these pinouts. The device circuit is defined by the device 130 such as a light, a negative lead from pinout #1 to the device and a positive lead from pinout #3 to the device 130 and the control element circuitry associated with these pins.

In the embodiment of FIG. 2B, when the power source 190 is coupled to the control circuit, the control circuit initially has the output in a low state with the device in the low state (device in the off mode). The control element 150 switches the device into a high state (device in the on mode) when switch S1 is pushed. The control element 150 then can switch the device into the low state (device in the off mode) when switch S2 is actuated and the device can stay in this mode until the device is reset by pushing on the switch S1 again.

Figure 3A:
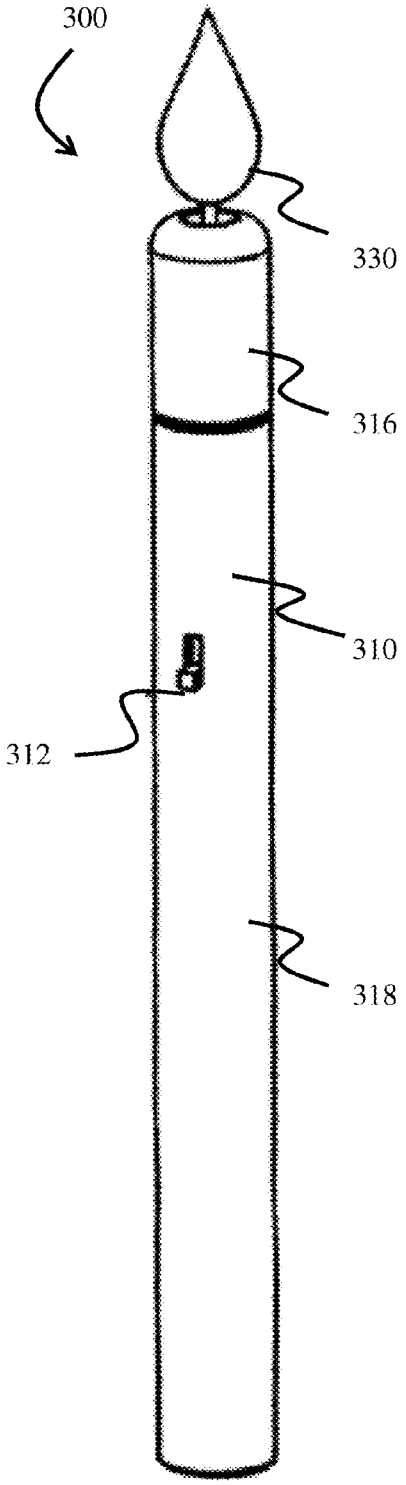
FIG. 3A illustrates an assembled view of one embodiment of an electronic candle.
Figure 3B:
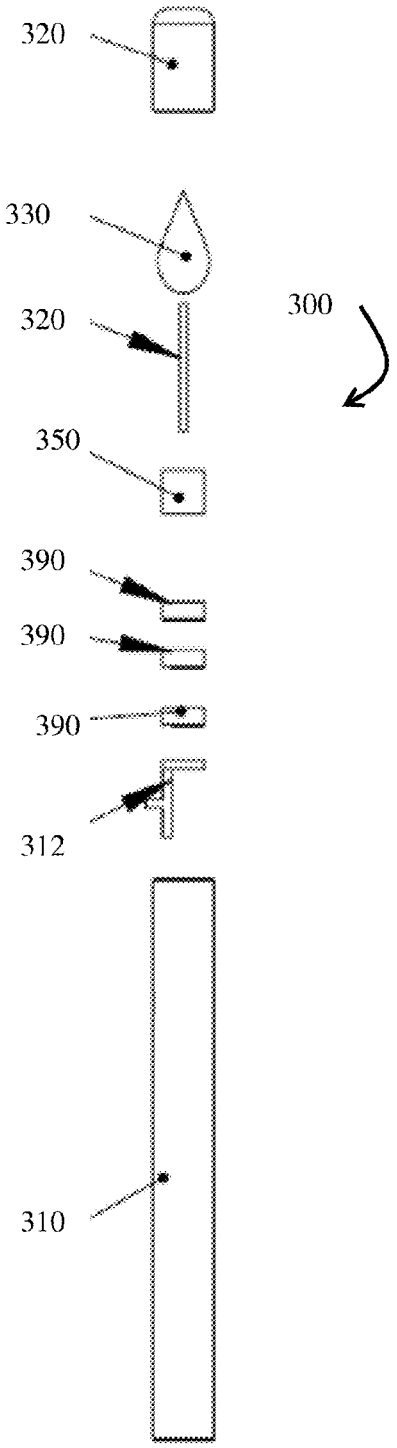
FIG. 3B illustrates an exploded view of one embodiment of an electronic candle.

In some embodiments, the body 310 may be made from multiple portions so that elements may be more easily accessible. As shown in FIG. 3A, in some embodiments, the body 310 may have a cylindrical stem portion 318 and a removable portion, such as a removable cap 316 that can be removed to provide access to an interior cavity of the body retaining elements such as the power source. FIG. 3B illustrates an exploded view of the embodiment of FIG. 3A. In this embodiment, the electronic candle assembly 300 comprises a removable cap 316, a device 330, a staff 320, a control element 350, a power source 390, a switch 312 and a body 310. The cylindrical stem portion 318 and the removable cap 316 may have interior cavities to retain elements and define a battery compartment to retain one or more batteries as the power source 190. In other embodiments, access to the interior cavities may be provided by other elements such as removable panels on the side of the body or by removable caps at the bottom of the body.

Figure 4A:
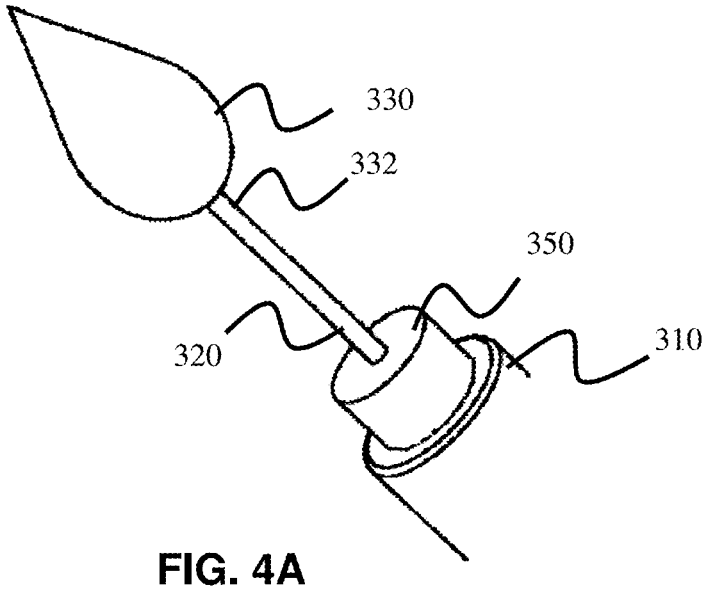
FIG. 4A illustrates one embodiment of one portion of a threshold circuit.
Figure 4B:
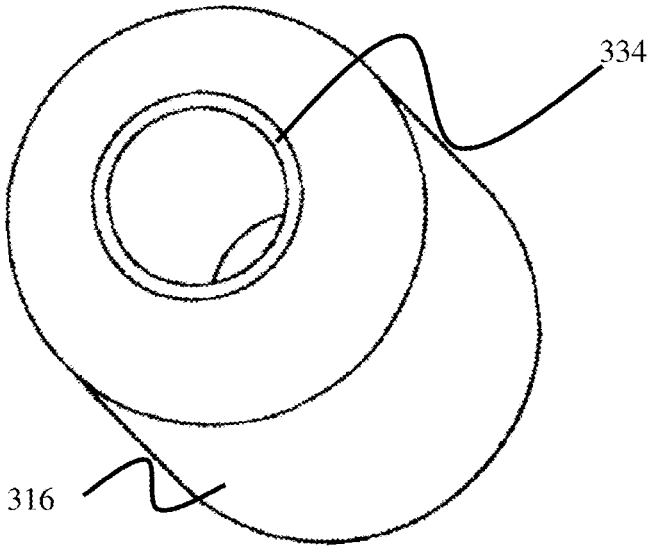
FIG. 4B illustrate one embodiment of another portion of a threshold circuit.

FIGS. 4A and 4B illustrate an alternative embodiment of the threshold circuit consistent with the embodiments of FIGS. 3A and 3B. FIG. 4A illustrates an alternative embodiment of the staff 320, the control element 350, and the second threshold switch contact 332 on the staff 320. FIG. 4B illustrates a removable cap 316 having the first threshold switch contact 334 on the interior of an opening of the removable cap 316. In an embodiment with these two configurations, the threshold switch contacts are conductively attached to the control element (not shown) such that when the staff 320 flexes sufficiently to eliminate a gap between the first and second contacts, the second threshold switch contact 332 comes in conductive contact with the first threshold switch contact 334.

Figure 5:
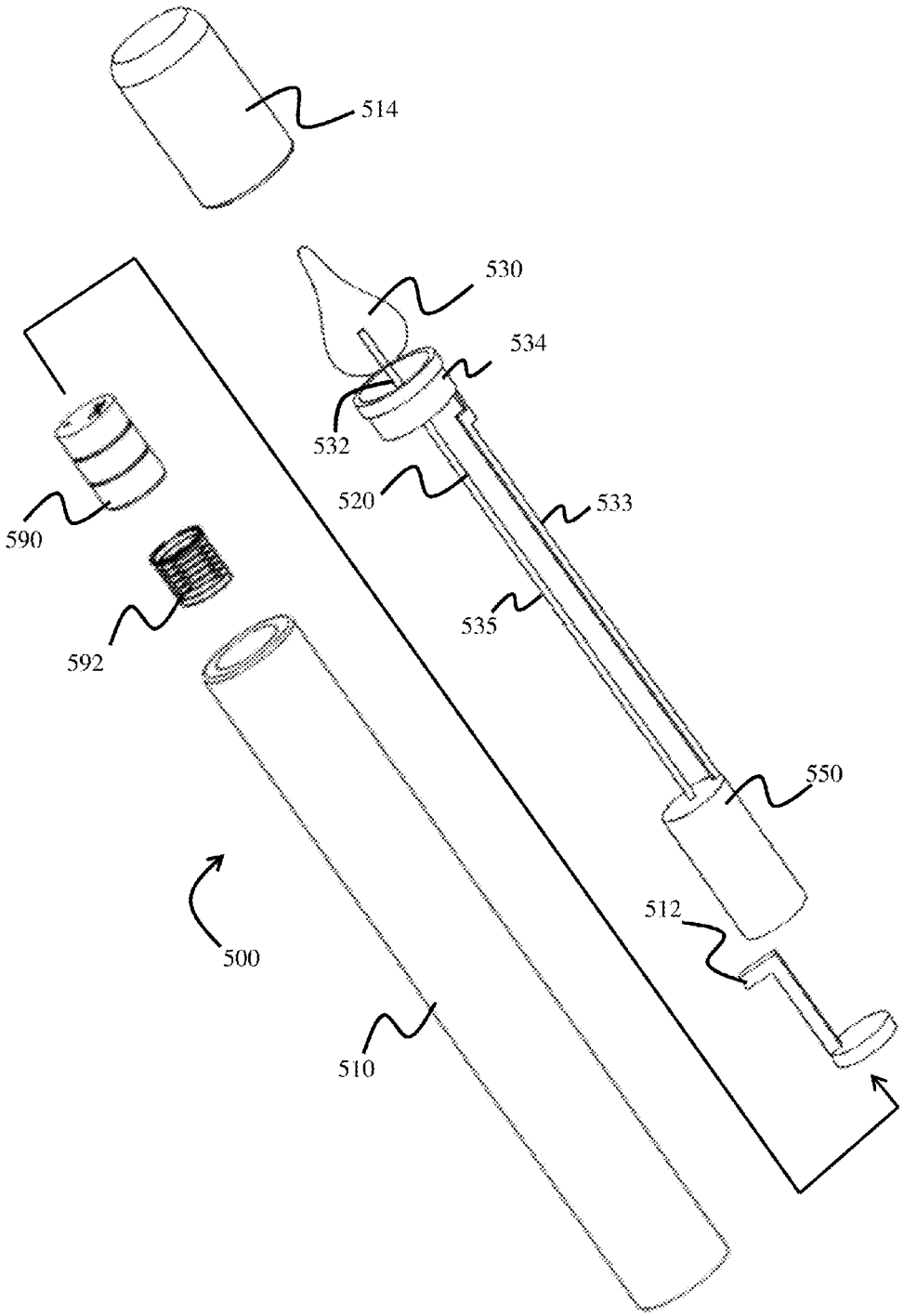
FIG. 5 shows an exploded view of another example embodiment of an electronic candle assembly.

FIG. 5 illustrates one example embodiment of an electric candle assembly 500 having an alternative embodiment of the threshold circuit. As shown, the electric candle assembly comprises a control element 550, a staff 520, a light 530, a cap 514, a switch 512, a power source 590, a body 510, a spring 592 and a threshold circuit. In this embodiment, the threshold circuit comprises a second threshold switch contact 532 and a first threshold switch contact 534. The second threshold switch contact 532 comprises a conductive element on the distal end of the staff 520 and is conductively attached to the control element 550 by a second lead 535. In some embodiments, the staff 520 is a conductive element such as a copper rod able to perform the function of both the second lead 535 and the second threshold switch contact 532. The first threshold switch contact 534 comprises a conductive portion of a conductive ring encircling the staff 520 and the second threshold switch contact 532 is a conductive element or a conductive portion of the staff 520. In some embodiments, as shown, the ring is a conductive ring and is in conductive contact with the control element 550 by a first lead 533.

Figure 6:
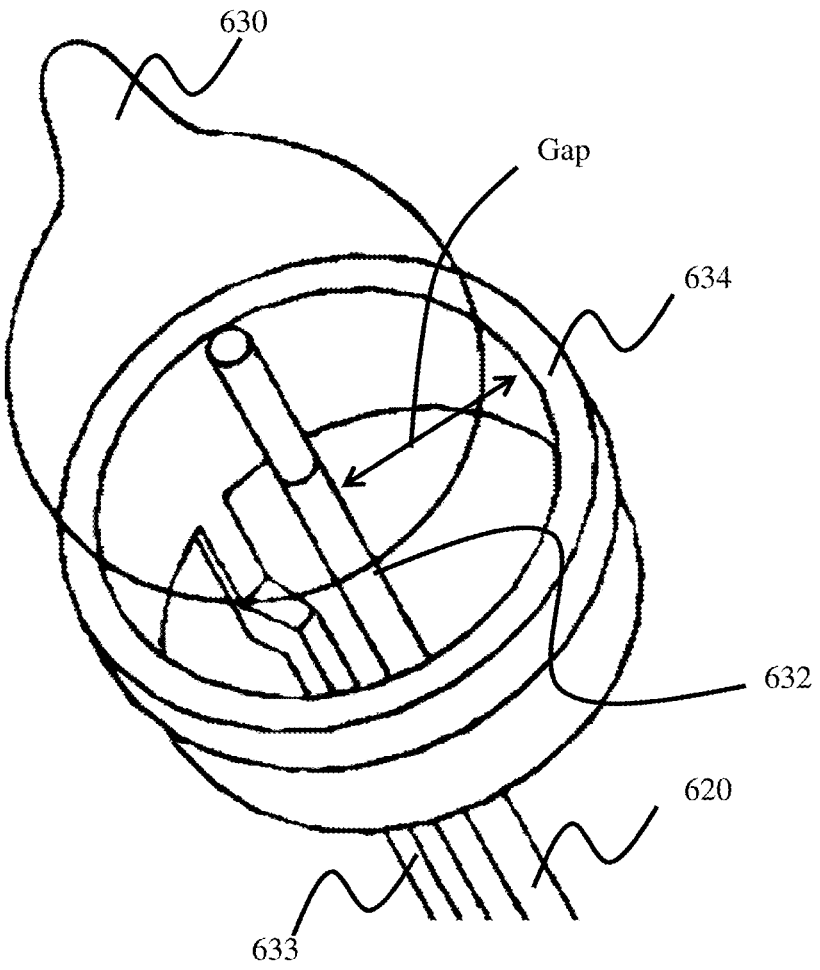
FIG. 6 illustrates portion of another embodiment of a threshold circuit.

FIG. 6 illustrates an example embodiment of the threshold circuit shown in FIG. 5 in more detail. As shown, the first threshold switch contact 634 comprises a conductive ring that is conductively attached to the first lead 633 and the control element (not shown). The second threshold switch contact 632 comprises a conductive element or a conductive portion of the staff 620. In this embodiment, the staff 620 is conductive and also functions as the second lead. As shown, the staff 620 is configured to move between an unflexed and a flexed position. The unflexed position defines a gap, identified here as the "Gap", between the second threshold switch contact 632 and the first threshold switch contact 634 and the flexed position defines a conductive contact of the first threshold switch contact 634 and the second threshold switch contact 632. With the embodiment shown, the threshold switch contacts are configured such that sufficient movement in any 360 direction of the staff and the light is able to create the conductive contact. In this embodiment, the second threshold switch contact 632 is a 360 degree conductive contact around the staff 620 and the first threshold switch contact 634 is a 360 degree conductive contact ring around the ring. It is understood that the configuration of the threshold switch contacts may be able to provide 360 degree contact without having a 360 degree ring around each threshold switch contact. For example only, and not for limitation, the second threshold switch contact may be a three or four pointed contact that is able to conductively contact a 360 degree ring as the first threshold switch contact. The conductive contact is capable of being made in any 360 degree direction is beneficial because it allows the electronic candle to more closely mimic the way that a real candle can be blown out from any direction.

Figure 7A:
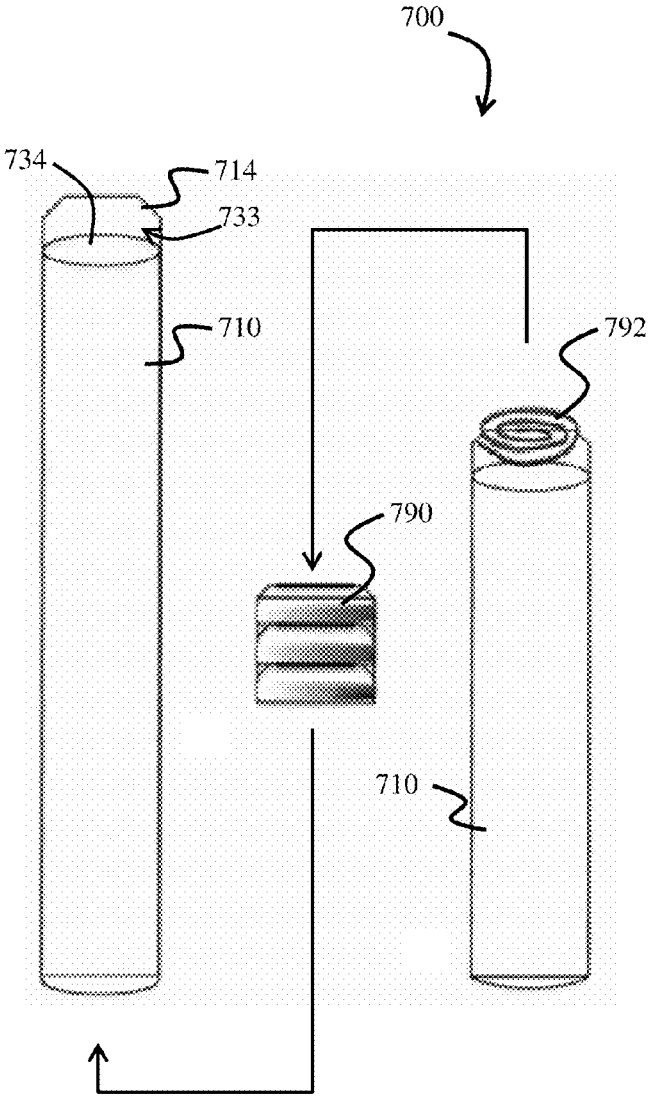
FIG. 7A shows an exploded view of another example embodiment of a threshold circuit.
Figure 7A:
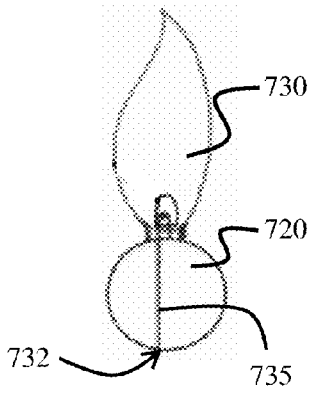

FIG. 7A illustrates an exploded view of another example embodiment of the electronic candle assembly 700 and the threshold circuit where the control circuit functions by a movement of threshold switch contacts that breaks a circuit from a power source to the light and switches the light from the on mode to the off mode. The embodiment shown comprises a body 710, a power source 790, a spring 792, a body insert 711, a cap 714, a staff, a light 730. As shown, the power source 790, such as batteries, are inserted into a cavity of the body 710 and the spring 792 and the body insert 711 are also inserted into the body 710 whereby the power source 790 is urged against the conductive element 734. In this embodiment, the control element comprises the threshold circuit defined by the threshold switch contacts. In this embodiment, the second threshold switch contact 732 is a proximal end of the second lead 735 conductively attached to the light 730 and extending through the staff, here a swivel ball 720. The first threshold switch contact is the conductive element 734 conductively attached to the power source 790. When installed in the body 710, the light 730 extends outside of an opening in the distal end of the cap 714 and the swivel ball 720 is retained within the opening by a reduced diameter of the opening. The swivel ball 720 is retained in the distal end of the body by a retaining chamber 733 defined by the reduced diameter of the opening in the cap and the conductive element 734. The swivel ball 720 is retained in the retaining chamber 733 but is also able to be rotated such that a force on the light 730 will rotate the swivel ball 720 from an unflexed position to a flexed position. In other words, the rotation of the swivel ball 720 rotates the second threshold switch contact 732 from conductive contact with the first threshold switch contact, here conductive element 734, breaking the circuit and switching the light 730 from the on mode to the off mode.

In the embodiment of FIG. 7A, although not shown, is a power circuit extending between the power source 790 and the light 730 whereby when the first and second threshold switch contacts are in conductive contact with each other, the power circuit conductively connects the light 730 to the positive and negative elements of the power source 790. In this embodiment, the leads of the threshold circuit may also function as leads in the power and/or the device circuit.

In some embodiments, the light is configured to have a surface area sufficiently sized or a surface profile sufficiently shaped to receive a force from a gas and translate that force such that the force moves the light and the staff from the unflexed position to the flexed position and the force from the gas switches the light from the on mode to the off mode. For example, the light is configured with a surface profile to move in response to a person blowing on the light at a force similar to someone trying to blow out a candle. In some embodiments, the light may have indentations or flat sail areas to enhance the light's resistance to the blowing of air and to more readily allow the moving of the staff and threshold switch contacts between the flexed and unflexed positions.

In some embodiments, dampening of the movement of the staff or the second threshold switch contact may be provided by a design of the staff or providing dampening skirts or bristles around one of the first or second threshold switch contacts. Other mechanical means may also be provided to restrict movements such as stiffeners of the staff or blocking elements that can be removed prior to the light going into the off mode.

Figure 8A:
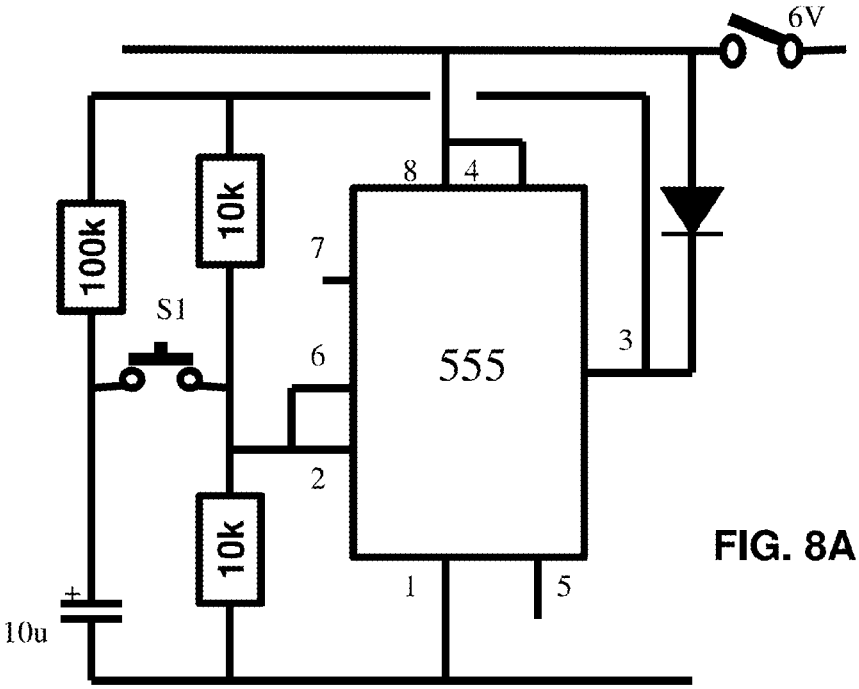
FIG. 8A illustrates an alternative embodiment of a control circuit utilizing a 555 integrated circuit.
Figure 8B:
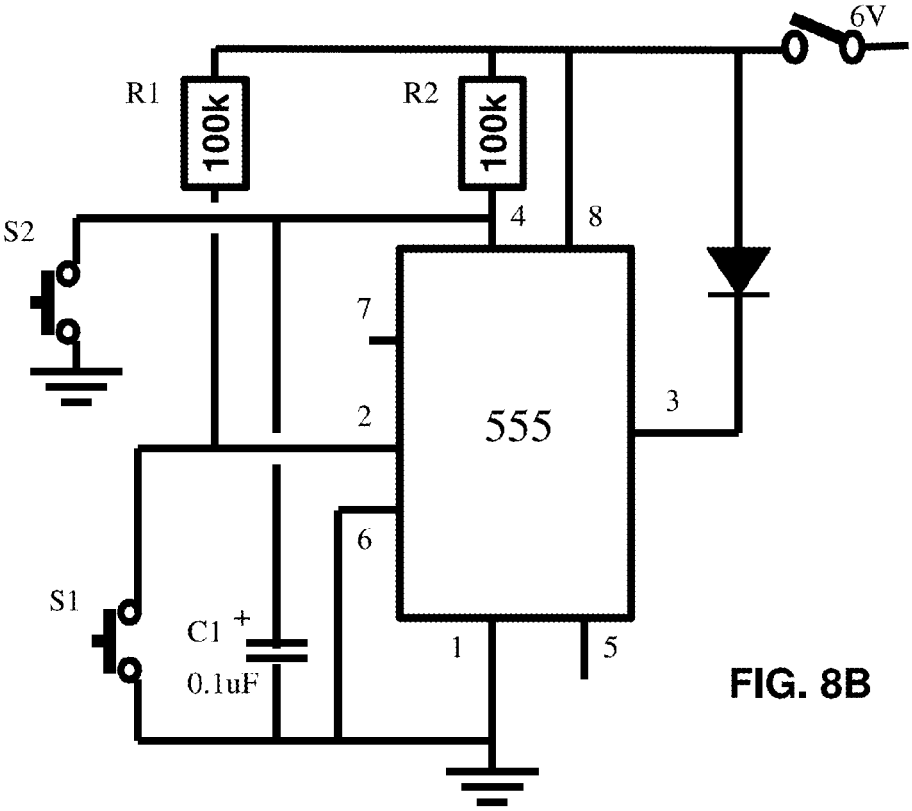
FIG. 8B illustrates an alternative embodiment of a control circuit utilizing a 555 integrated circuit.

It is understood that multiple circuit designs and switches could provide the on/off switch functionality to the device and allow for a flexing of the device to switch the device to an off mode when the threshold switch contact moves into a flexed position. Shown in FIG. 8A is an example embodiment of a control circuit that functions similar to an on/off circuit. The device is initially powered on by an on/off switch and this is switched into the off mode by the switch S1 which functions similar to the threshold switch. When the device has been used, it is powered off by opening the on/off switch. In this embodiment, the changes in the circuit design would require associated changes in connectivity of the 555 IC with other element of the electronic candle assembly. Shown in FIG. 8B is another alternative embodiment of a control circuit that functions similar to a tilt circuit. The device is initially powered on by an on/off switch and the device is then switched into the off mode by threshold switch S1 in the normal placement of a tilt switch. This configuration also has a reset switch S2 that can reset the device to the original on mode. This configuration would also require the connectivity with the 555 IC to align with the circuit diagram shown.

In some embodiments utilizing the 555 IC, it is possible to configure a time that the "pulse" of the 555 IC keeps the device in different states. The pulse duration is a function of the resisters and the capacitors of the circuit and may be helpful to reset the electronic candle assembly back to an on state after a period of time. Timing the state of the device may also provide an ability for some circuit designs to keep switches from flipping the state of the device for a period of time.

One Embodiment of the Electric Candle Assembly in Operation:

Operation of an example embodiment of the electric candle assembly generally comprises the steps of providing an electronic light assembly, switching the power switch to conductively attach the power source to the control element and the light and blowing on the portable electronic light to generate a gas causing the control element to switch the light from the on mode to the off mode. In this embodiment, the electronic light assembly generally comprises a control circuit having a power source, a control element, a power switch and a light, For purposes of illustrating the operation of one embodiment of the electric candle assembly, and not for limitation, the operation of the embodiment shown in FIGS. 1A and 1B is described. In that embodiment, the electronic candle comprises a body 110 having a distal end 114, a control circuit comprising a control element 150, a power circuit, a device circuit and a threshold circuit. In this embodiment, when the batteries are installed, power is provided to the control element 150 however current/power is not necessarily provided to the device circuit. When the on/off switch 112 in the power circuit is turned on, a power source 190 is conductively attached to the device circuit and until the threshold switch is actuated, the control element 150 provides an output in a high, or on mode to the device circuit and the light 130. As configured, the control element 150 provides the output to the device circuit and the light 130 putting the light 130 in a high state, or on mode. In some embodiments, such as the configuration shown for FIG. 1B, the control element 150 may always be conductively attached with the control element 150 and the on/off switch is used to control when power from the power source 190 is provided from the control element 150 to the device 130. As configured, the threshold circuit is initially in an open state. This allows the control circuit to provide an output keeping the light 130 in the on mode until the threshold circuit is actuated. The threshold circuit comprises control element circuitry conductively attached to the first threshold switch contact 134 positioned at the distal end of the body 110 and a second lead and a second threshold switch contact 132 positioned at a gap from the first threshold switch contact 134. In the threshold circuit, the first lead conductively attaches the threshold circuit and the first threshold switch contact 134, the second lead conductively attaching the threshold circuit and the second threshold switch contact 132. The second threshold switch contact 132 is configured to move between an unflexed and a flexed position where the unflexed position defines the gap between the first threshold switch contact 134 and the second threshold switch contact 132 and the flexed position defines a conductive contact of the threshold switch contacts whereby the conductive contact actuates the control circuitry and switches the light 130 from the on mode to the off mode. Operationally, the threshold circuit is actuated by a force of gas on the device 130, such as by blowing as if you were to blow out a candle flame, and the force moves the device 130 and flexes the second threshold switch contact 132. In the embodiment shown, the second threshold switch contact 132 flexes on the distal end of the staff 120. The flexing of the second threshold switch contact 132 causes a conductive contact with the first threshold switch contact 134 closing the threshold circuit and exceeding a threshold of the control element 150 which switches the output of the control circuit from a high state to a low state whereby the light 130 is put in an off mode. When the control element is a 555 IC, the closing of the threshold circuit causes the voltage on pinout #6 to exceed the threshold voltage and this causes the output from pinout #3 to be switched into a low state which switches the power to the light 130 to the off mode.

The electronic candle of FIG. 5 operates in a similar manner to the embodiment shown in FIGS. 1A and 1B where the threshold circuit is able to switch the device from the on mode to the off mode when the threshold switch contacts come into conductive contact.

Figure 7B:
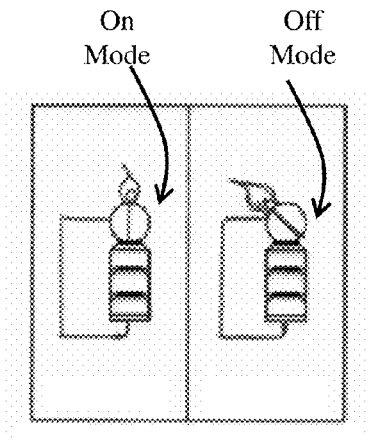
FIG. 7B shows the flexed and unflexed positions of the staff in the embodiment of FIG. 7A.

The configuration of the electronic candle of FIG. 7A is implemented with a different staff configuration and does not have an integrated circuit as a control element. Operationally, this embodiment operates by having an on/off switch (not shown) conductively attaching the power source to the light through the swivel ball 720 as the staff. With the power connected to the light 730, the light 730 is in the on mode. When a force or pressure, such as blowing air, is applied to the light 730, the force on the light 730 causes the swivel ball 720 to rotate which causes the second threshold switch contact 732 to move away from the first threshold switch contact, here conductive element 734, or in other words move into a flexed position, that opens circuit between the first and second threshold switch contacts and switches the light 730 into the off mode. FIG. 7B shows the position of the threshold switch contacts and the swivel ball 720 in both the on mode and the off mode. Because the swivel ball 720 can be swiveled in 360 degrees, the light 730 can be switched from a force coming from any direction.

The embodiments reflected by the control circuit diagrams of FIGS. 8A and 8B operate in a similar manner to the embodiments of FIGS. 1A, 1B and 5 with slight variations to account for the variations in circuitry such as changing the conductivity to align with the pinouts identified in the circuit diagrams. In the embodiment of FIG. 8A, the device is turned on by turning the power switch on and the device is turned off by the conductive contact of the threshold switch contacts that function as the switch S1. In the embodiment of FIG. 8B, the device is turned on by turning the power switch on. The device is turned off by the conductive contact of the threshold switch contacts as S1 and the device may be reset by pushing the reset switch S2.

Although this invention has been described in the above forms with a certain degree of particularity, it is understood that the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention which is defined in the claims and their equivalents.

I claim:

1. An electric candle assembly, the assembly comprising:
a body having a distal end;
a control circuit;
the control circuit comprising a threshold circuit;
the threshold circuit comprising a control element conductively attached to: a light, a first threshold switch contact positioned at the distal end of the body and a second threshold switch contact positioned at a gap from the first threshold switch contact;
the control circuit configured to switch the conductivity to a light between an on mode and an off mode;
the second threshold switch contact configured to move between an unflexed position and a flexed position;
the unflexed position defines the gap between the first threshold switch contact and the second switch threshold contact; and
the flexed position defines a conductive contact of the first threshold switch contact and the second threshold switch contact whereby the conductive contact switches the light from the on mode to the off mode.

2. The electric candle assembly of claim 1 wherein:
the light defines an area to receive a force from a gas; and
the force moves the light and moves the second threshold switch contact from the unflexed position to the flexed position whereby the force from the gas switches the light from the on mode to the off mode.

3. The electric candle assembly of claim 1 wherein:
the second threshold switch contact is positioned on a distal end of a staff; and
the second threshold switch contact is configured to move between the unflexed and the flexed position by one of a flex of the staff or a flex of a hinge coupled to the staff.

4. The electric candle assembly of claim 1 wherein:
the first threshold switch contact comprises a conductive ring;
the second threshold switch contact comprises a conductive element capable of conductively contacting the conductive ring;
the second threshold switch contact is configured to move between the unflexed and the flexed position by one of a flex of the staff or a flex of a hinge coupled to the staff;
the light defines an area to receive a force from a gas; and
the force moves the light and the second threshold switch contact from the unflexed position to the flexed position whereby the force from the gas switches the light from the on mode to the off mode.

5. The electric candle assembly of claim 4 wherein the conductive element is capable of conductively contacting the conductive ring through a 360 degree direction of flex.

6. The electric candle assembly of claim 1 wherein the control circuit further comprises a power circuit comprising a power switch configured to conductively attach a power source to the control element.

7. The electric candle assembly of claim 1 wherein the conductive contact of the first threshold switch contact and the second threshold switch contact is a momentary conductive contact.

8. The electric candle assembly of claim 7 wherein the momentary conductive contact switches the light from the on mode to the off mode and the light remains in the off mode after a subsequent conductive contact.

9. The electric candle assembly of claim 1 wherein the control element comprises a 555 integrated circuit.

10. The electric candle assembly of claim 9 wherein the 555 circuit is conductively attached as follows:
a pinout #1 to a first contact of a power switch, a first contact of a power source and a first contact of the light;
a pinout #2 to a second contact of the power switch;
a pinout #3 to a second contact of the light;
a pinout #6 to the second threshold switch contact; and
a pinout #8 to a second contact of a power source and the first threshold switch contact.

11. The electric candle assembly of claim 10 wherein:
the light defines an area to receive a force from a gas;
the force moves the light and moves the staff from the unflexed position to the flexed position whereby the force from the gas switches the light from the on mode to the off mode;
the second threshold switch contact is positioned on a distal end of a staff;
the second threshold switch contact is configured to move between the unflexed and the flexed position by one of a flex of the staff or a flex of a hinge coupled to the staff;
the control circuit further comprises a power circuit comprising a power switch configured to conductively attach the power source to the control element;
the conductive contact of the first threshold switch contact and the second threshold switch contact is a momentary conductive contact;
the momentary conductive contact switches the light from the on mode to the off mode and the light remains in the off mode after a subsequent conductive contact;
the body comprises a cylindrical stem portion and a removable cap portion;
the light comprising an LED light having a shape simulating a flame; and
the cylindrical stem portion defining a battery compartment to retainer a battery as the power source.

12. A method of using an electronic candle assembly, the method comprising:
providing a portable electronic light comprising the electric candle assembly of claim 1;
switching a power switch to conductively couple a power source to the control element and the light; and
blowing on the light to cause the threshold circuit to switch the light from the on mode to the off mode.

13. A switchable electric device, the device comprising:
control circuitry configured to switch a device from an on mode to an off mode;
a second threshold switch contact;
a body comprising a first threshold switch contact;
the second threshold switch contact configured to move between an unflexed position and a flexed position in response to a force on the device from a gas;
the unflexed position defines a gap between the first threshold switch contact and the second switch threshold contact; and
the flexed position defines a conductive contact of the first threshold switch contact and the second threshold switch contact whereby the conductive contact actuates the control circuitry and switches the device from the on mode to the off mode.

14. The switchable electric device of claim 13 wherein the second threshold switch contact is positioned on a staff.

15. The switchable electric device of claim 13 wherein:
the first threshold switch contact is positioned on the distal end of the body;
the second threshold switch contact is positioned on the distal end of the staff; and
the unflexed position comprises a flexing of the staff whereby the second threshold switch contact moves been the unflexed position and the flexed position.

16. The switchable electric device of claim 13 wherein:

the staff comprises a swivel ball;

the second threshold switch contact comprises a proximal end of a lead conductively attached to the device;

the second threshold switch contact comprises a contact in conductive contact with a power source; and the unflexed position comprises a rotation of the swivel ball whereby the swivel ball moves been the unflexed position and the flexed position.

17. The switchable electric device of claim 13 further comprising:

the device comprises a light;

the control circuitry comprising a control element, a threshold circuit, a device circuit and a power circuit;

the power circuit comprising an on/off switch conductively attached with the control element;

the device circuit comprising the light conductively attached with the control element;

the power circuit comprising a power source conductively attached with the control element;

the staff having a proximal end and a distal end;

the light positioned on the distal end of the staff; and the second threshold switch contact positioned on the distal end of the staff and the first threshold switch contact positioned on a distal end of the body whereby a force on the light moves the staff from the unflexed position to the flexed position and the conductive contact of the second threshold switch contact with the first threshold switch contact switches the device from the on mode to the off mode.

18. An electronic candle assembly comprising:

a body having a distal end;

a light;

a power source conductively attached to control circuitry to control the conductivity between the power source and the light;

the control circuitry comprises a threshold circuit to switch the light from an on mode to an off mode; and the threshold circuit is configured to receive a force on the light from a gas whereby the force moves the light and the second threshold switch contact from an open threshold circuit position to a closed threshold circuit position and the control circuitry switches the light from the on mode to the off mode.

19. The electronic candle assembly of claim 18 wherein the control circuitry further comprises a control element comprising a 555 integrated circuit.

20. The electronic candle assembly of claim 18 wherein:

the threshold circuit comprises a first lead, the first threshold switch contact positioned proximal to the distal end of the body, a second lead and a second threshold switch contact positioned proximal to the distal end of the staff;

the first lead conductively attaching the threshold circuit and the first threshold switch contact;

the second lead conductively attaching the threshold circuit and the second threshold switch contact;

the staff configured to move between an unflexed and a flexed position;

the unflexed position defines a gap between the first threshold switch contact and the second switch threshold contact; and the flexed position defines a conductive contact of the first threshold switch contact and the second threshold switch contact whereby the conductive contact switches the light from an on mode to an off mode.

* * * * *